United States Patent [19]

Florkiewicz et al.

[11] Patent Number: 4,747,509

[45] Date of Patent: May 31, 1988

[54] LID WITH DETACHABLE SEGMENT

[75] Inventors: Warren F. Florkiewicz, Paradise Valley; Hubert E. Christian, Phoenix, both of Ariz.

[73] Assignee: WMF Container Corporation, Phoenix, Ariz.

[21] Appl. No.: 60,940

[22] Filed: Jun. 9, 1987

Related U.S. Application Data

[63] Continuation of Ser. No. 809,840, Dec. 13, 1985, abandoned, which is a continuation of Ser. No. 604,033, Apr. 26, 1984, abandoned.

[51] Int. Cl.[4] ..... B65D 41/48

[52] U.S. Cl. ..... 220/270; 220/90.4; 229/906.1

[58] Field of Search ..... 220/90.2, 90.4, 270; 229/7 R, 906.1; 215/254

[56] References Cited

U.S. PATENT DOCUMENTS

| | | | |
|---|---|---|---|
| 783,859 | 2/1905 | Goltstein | 215/254 |
| 1,242,604 | 10/1917 | Schmitt | 215/254 |
| 1,604,123 | 10/1926 | Ingram | 215/254 |
| 2,689,664 | 9/1954 | Vingron | 229/7 R X |
| 3,368,707 | 2/1968 | Johnson et al. | 215/254 |
| 3,421,681 | 1/1969 | Frank | 215/254 X |
| 3,800,999 | 4/1974 | Serritella | 229/7 R |
| 3,933,264 | 1/1976 | Rossi | 229/7 R X |
| 3,937,349 | 2/1976 | Hsu | 215/254 |
| 3,938,695 | 2/1976 | Ruff | 220/90.4 |
| 3,994,411 | 11/1976 | Elfelt et al. | 220/90.4 |
| 4,081,103 | 3/1978 | Zoellick | 229/7 R |
| 4,184,604 | 1/1980 | Amberg et al. | 220/90.4 X |
| 4,184,605 | 1/1980 | Hanson | 220/270 X |
| 4,209,126 | 6/1980 | Elias | 220/270 X |
| 4,215,793 | 8/1980 | Packard | 220/90.4 X |
| 4,473,167 | 9/1984 | Bailey | 220/90.4 |
| 4,502,608 | 3/1985 | Mills | 220/90.4 |

FOREIGN PATENT DOCUMENTS

| | | | |
|---|---|---|---|
| 1563966 | 4/1969 | France | 220/270 |

*Primary Examiner*—Allan N. Shoap
*Attorney, Agent, or Firm*—Paul R. Wylie

[57] ABSTRACT

A lid is provided for an open top container. The lid is made from a frangible material such as plastic. A tearable tab is defined by a pair of score lines each of which is on two spaced sections of the lid. The sections are located at least partially in different planes of the lid. The spacing between the sections defines a wall portion including at least another plane of the lid. This spacing is free of score lines to form a gap in each of the pair of score lines. The spaced sections of each of the pair of score lines are otherwise in alignment.

5 Claims, 2 Drawing Sheets

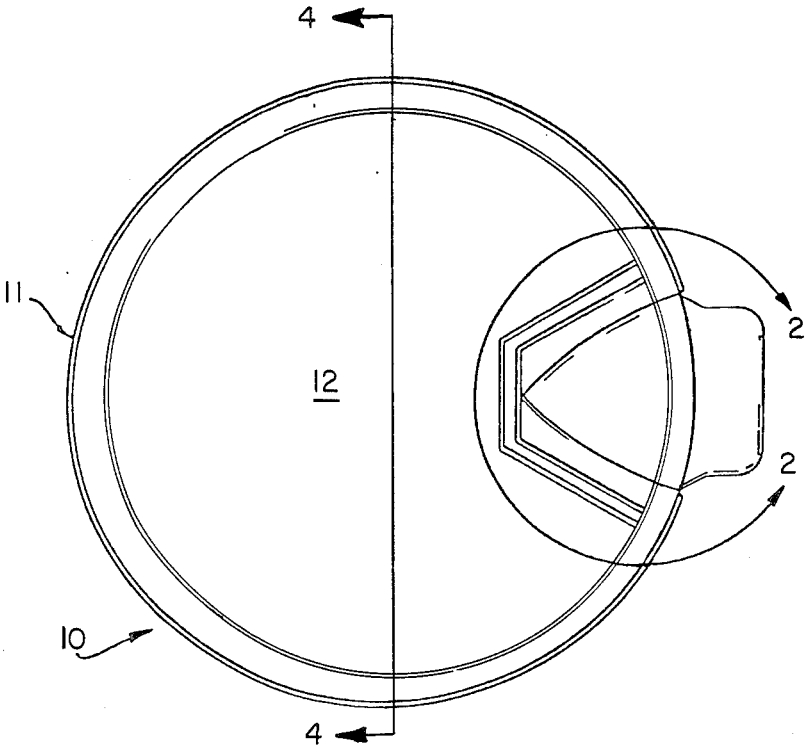
FIG. 1
FIG. 2
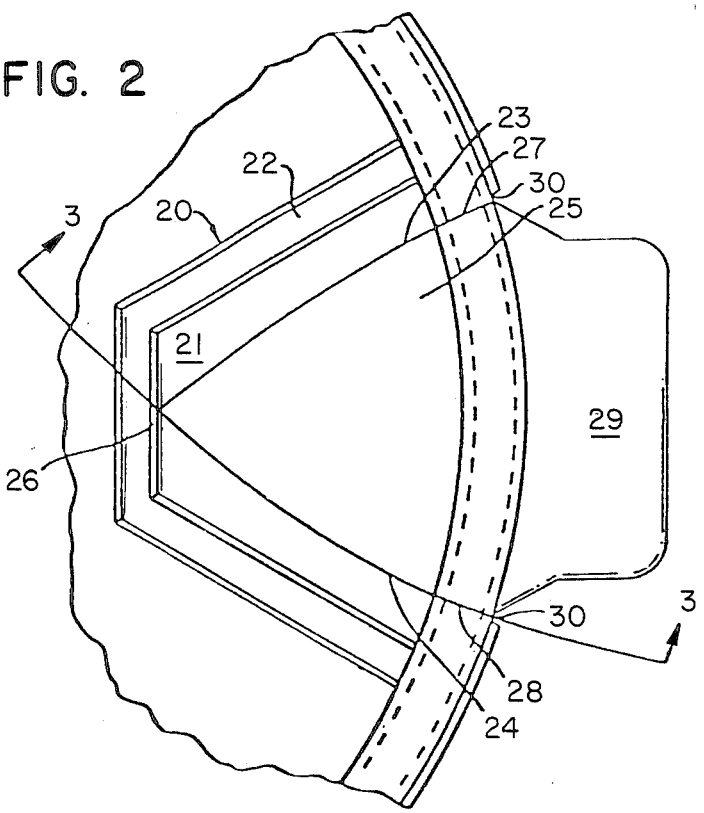

LID WITH DETACHABLE SEGMENT

This is a continuation of application Ser. No. 809,840 filed on Dec. 13, 1985 which is a continuation of Ser. No. 604,033 filed on Apr. 26, 1984, both abandoned.

BACKGROUND OF THE INVENTION

Beverage service in fast food restaurants, concession stands and other locations where beverages are dispensed commonly utilize containers having lids formed of thin plastic material. It is desirable to have a means for opening a portion of such lids so that the beverage can be consumed from the container while at the same time a major portion of the lid remains intact on the container to prevent spillage. Prior art lids of this type have included segments defined by predetermined score lines which were intended to rupture so that the segment could be removed. It was found however that many times the material of the lid would not rupture along the score lines provided, but rather would tear in erratic fashion into the material adjacent the score lines. It has now been determined in accordance with this invention that a score line configuration can be devised which will permit reliable rupturing along an intended path and result in complete freeing of a lid segment.

SUMMARY

According to this invention, there has been provided a lid for an open top container that is made of frangible material such as plastic. The lid includes a perimeter, for engaging the edge of an open top container, and a central planer portion. The perimeter has at least an upper and outer wall portion adapted to fit over a container rim and score lines on the central planer portion to define a removable segment. These score lines comprise two lines extending from a point of intersection on the central planer portion outwardly to the perimeter where at least one of the upper wall has extending portions of the score lines. Tab means for applying finger pressure are provided on the outer wall within the segment defined by the score lines. The tab means are finger movable to permit upward pressure to be applied to the perimeter and said segment whereby the material of the lid will be ruptured at the score lines to free the segment from the container and from the remainder of the lid.

An important feature of the invention is the provision of terminating the inner ends of the two score lines defining the segment at a point of intersection. It has been found according to the invention that terminating the score lines in this manner, rather than a radius or intersecting straight line as has been done in the prior art, helps the segment to tear clean of the lid and prevents cross tears in erratic directions which produce jagged edges and in some cases incomplete removal of the segment. It has also been found in accordance with a preferred form of the invention that if the score lines are arcuate in nature, erratic or cross tears are further prevented. In a further preferred form of the invention, it has been found that best results are obtained if the angle of divergence of the score lines at their point of intersection is less than about 90°.

An important feature of the invention is the provision of extending portions of the score lines on the upper wall of the perimeter of the lid. The fact that these score lines are discontinuous extensions and not a continuation of the score lines that are in the center of the lid provides for constructional stability of the lid and prevents accidental or inadvertent removal or tearing of the segment.

In another preferred form of the invention, there is provided a lid having a perimeter comprising a U-shaped groove with inner, upper and outer walls of which the upper wall contains an extended portion of the score lines that are in the planer portion of the lid. This results in a lid that will not only more tightly engage with a container but also be structurally sound, avoid accidental tears and inadvertent removal of the segment and permit the intentional removal of the segment by finger pressure.

In another preferred embodiment of the invention, the lid includes notches in the outer wall adjacent to the tab means such that the material of the lid will commence to tear at the notches when upward finger pressure is applied to the tab.

It was an object of this invention to provide a container lid from which a segment could be reliably and readily removed.

It was a further object of this invention to provide such a container lid that would result in controlled tearing of a segment to be removed from the lid.

Further objects of the invention were the provision of a lid of the foregoing type wherein fluid leakage from a container upon which the lid was placed was eliminated.

DESCRIPTION OF THE DRAWINGS

The invention will be more fully understood and described with reference to the following drawings wherein:

FIG. 1 is a top plan view of the lid according to the invention;

FIG. 2 represents an enlarged view taken within lines 2—2 of FIG. 1 showing details of the invention;

DETAILED DESCRIPTION OF THE INVENTION

Figure 3:
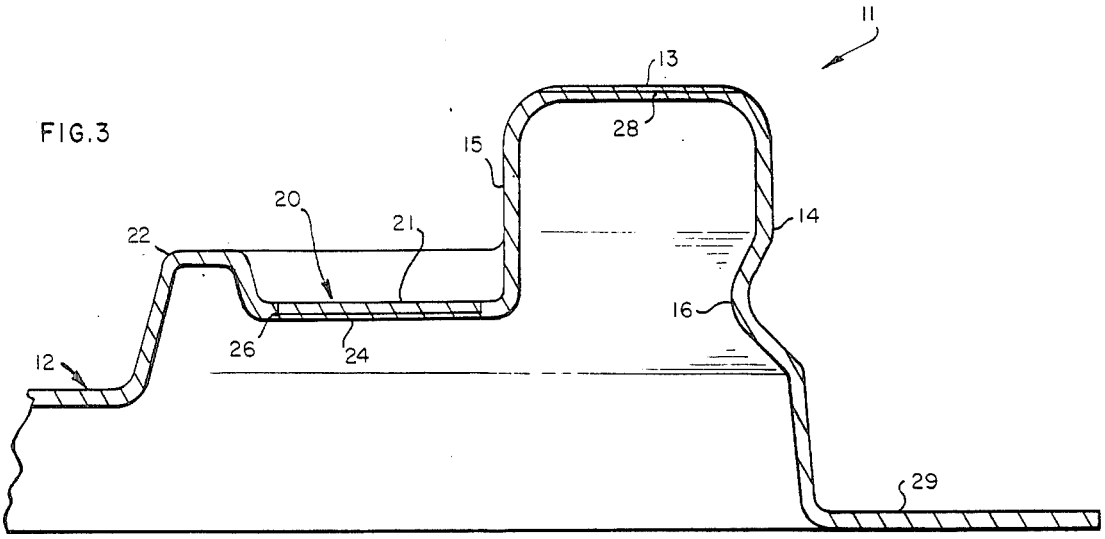
FIG. 3 is a view in cross-section taken on lines 3—3 of FIG. 2.
Figure 3A:
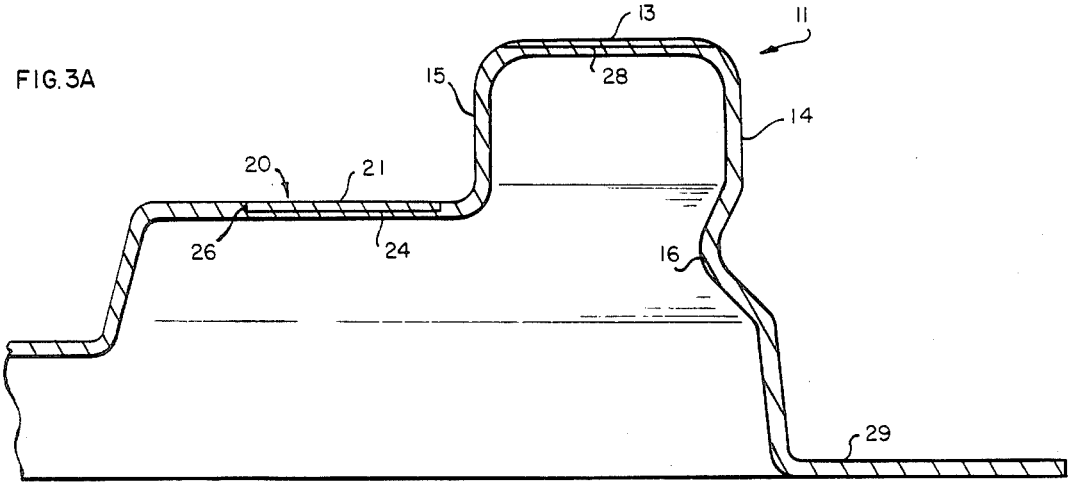
FIG. 3*a* is a view similar to FIG. 3 showing an alternate embodiment of the invention.
Figure 4:
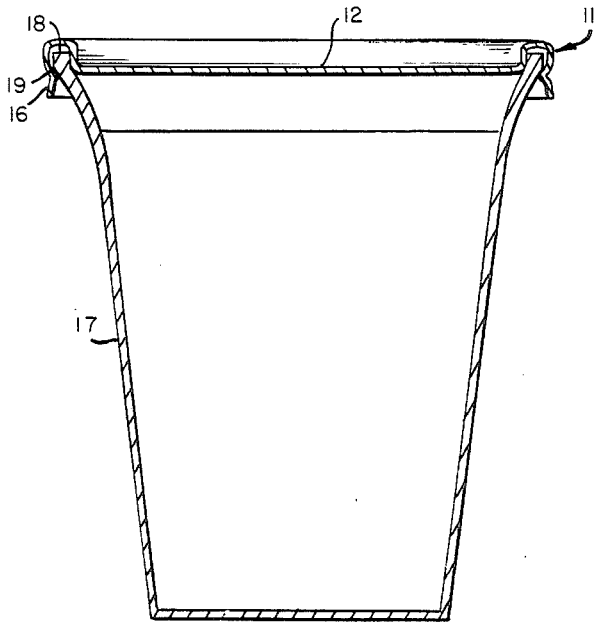
FIG. 4 is a view in cross-section taken on lines 4—4 of FIG. 1 and further showing a container to which the lid according to the invention is engaged.

Referring now to the drawings, there is shown in FIG. 1 a lid 10 for an open topped container. The lid is formed of a frangible material that can be torn when stress is applied and typically is formed of thin plastic sheet material such as styrene, polyethylene or polypropylene sheet. The lid comprises a perimeter 11 for engaging the edge of an open topped container and a central planer portion 12. As best shown in FIG. 3, the perimeter 11 includes an upper wall portion 13 and an outer wall portion 14. In a preferred form of the invention, there is also included an inner wall portion 15 to form a downwardly directed U-shaped groove. Outer wall portion 14 can have an inwardly extending groove 16 which serves to firmly secure the lid to an open topped container that may or may not have a corresponding bead portion. An example of an open topped container with the lid of the invention affixed thereto is shown in FIG. 4 wherein the container 17 is typically formed of a foamed polystyrene material and has an open top 18 including a bead 19 over which inwardly extending groove 16 will fit to secure the lid.

In a preferred form of the invention, central planer portion 12 includes a raised portion 20 formed by intermediate planer portion 21 and includes a peripheral raised rib 22.

Score lines 23 and 24 are present on the raised portion 20 which is part of central planer portion 12. Such score lines 23 and 24 define a removable segment 25 which can be separated from the lid 10 when it is secured to an open topped container as will be hereinafter described. In a preferred form of the invention, the score lines are arcuate and continuous and extend from a point of intersection 26 on said intermediate plane outwardly to perimeter 11. Upper wall 13 has extending portions 27 and 28 of said score lines which are in line (ie. aligned, as shown in the drawings) with score lines 23 and 24 but are separated from them by an area of unscored materials shown.

Extending outwardly from outer wall 14 is a finger movable tab 29. The tab permits upward pressure to be applied to perimeter 11 within the segment defined by the score lines 23 and 24 as well as the extending portions 27 and 28 of said score lines. Upon application of upward pressure, the material of the lid at said score lines will be ruptured to free segment 25 from the container and from the remainder of the lid 10. While an outwardly extending tab 29 is shown, any tab sufficient to permit finger movement to apply upward pressure will suffice.

In a preferred embodiment of the invention, the score lines 22 and 23 and extending portion 27 and 28 are cut only about 70% to about 80% of the thickness of the materials of the lid. This provides a sufficient weakened portion at the score line for the lid to rupture when upward pressure is applied to tab 28 while at the same time preventing leakage from the score cut. The score lines can be cut into the upper portion of the lids from the top, as shown, or alternately cut into the lower portion of the lids from the bottom. In another alternate embodiment, not shown, extending portions 26 and 27 can be cut completely through upper wall 13 and into one or both outer and inner walls 14 and 15 respectively.

It has been found that terminating arcuate score lines 23 and 24 in a point of intersection 26 rather than at a radius or straight line helps the tab to tear clean and prevents cross-tearing in erratic directions. In a preferred form of the invention, the initial angle of divergence of score lines 22 and 23 from point of intersection 26 will be less than about 90°.

The material in outer wall 14, and inner wall 15 that does not have an extending portion 27 or 28 of score lines 23 and 24 will uniformly rupture along a path that is substantially in alignment with said score lines and extending portions.

In a further preferred form of the invention, outer wall 14 is provided with notches 30 adjacent tab 29. These notches are generally in a position opposite the extending portions 27 and 28 of score lines 23 and 24 and serve to provide a point where the lid will commence tearing when upward pressure is applied to tab 29.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A lid for an open topped container, said lid being of frangible material and comprising a perimeter for engaging the edge of said open topped container, said lid comprising a central region having (a) a main planar portion and (b) a raised planar portion bounded partially by a sector of said perimeter and partially by a raised rib, and said perimeter having upper, inner and outer wall portions forming a downwardly extending U-shaped groove, score lines on said raised planar portion defining a removable movable segment thereof, said score lines comprising two lines extending from a point of intersection with each other on said raised planar portion outwardly to said perimeter, at least one of said upper and outer walls of said perimeter being scored with an extending portion of said score lines, said extending portion of said score lines being aligned with said score line at said perimeter, and being separated from said score lines by an area of unscored material comprising substantially a wall portion; and tab means associated with said outer wall in the segment defined by said score lines, said tab means being finger movable to permit upward pressure to be applied to said perimeter and said segment, whereby the material of said lid at said score lines will be ruptured to free said segment from said container and from the remainder of said lid.

2. A lid according to claim 1 wherein the intial angle of divergence of said score lines from said point of intersection is less than about 90°.

3. A lid according to claim 1 wherein said tab means is comprised of an outwardly extending finger grippable flange segment.

4. A lid according to claim 1 wherein said lid further comprises notches in a lower portion of said outer wall adjacent said tab means and at a position opposite said score lines and extending portion whereby the material of said lid will commence tear at the apex of said notches when upward pressure is applied to said finger movable tab.

5. A lid according to claim 1 wherein said score lines are arcuate.

* * * * *